United States Patent [19]

Abrams

[11] 4,038,795

[45] Aug. 2, 1977

[54] CONCRETE STORAGE TANK AND METHOD OF MAKING SAME

[76] Inventor: Ned H. Abrams, 1363 Zurich Terrace, Sunnyvale, Calif. 94087

[21] Appl. No.: 604,958

[22] Filed: Aug. 15, 1975

[51] Int. Cl.[2] ..... E02D 27/00

[52] U.S. Cl. ..... 52/169.7; 52/192; 52/247; 52/259; 52/294; 52/378

[58] Field of Search ..... 52/192–196, 52/224, 245, 259, 293, 294, 295, 378, 319, 247, 169, 258

[56] References Cited

U.S. PATENT DOCUMENTS

| | | | |
|---|---|---|---|
| 1,425,117 | 8/1972 | Lynde | 52/259 X |
| 2,382,171 | 8/1945 | Pomykala | 52/245 |
| 2,746,283 | 5/1956 | Abrams | 52/259 X |
| 3,180,057 | 4/1965 | Pritzker | 52/293 X |
| 3,195,312 | 7/1965 | Rumsey, Jr. | 52/293 X |
| 3,233,376 | 2/1966 | Naillon et al. | 52/264 |
| 3,289,366 | 12/1966 | Abrams | 52/174 |

OTHER PUBLICATIONS

"Big Prestressed Tanks Built With Precast Panels," *Civil Engineering,* 9-1955, vol. 25, No. 9, pp. 44–46.

*Primary Examiner*—Price C. Faw, Jr.
*Assistant Examiner*—Carl D. Friedman
*Attorney, Agent, or Firm*—Boone, Schatzel, Hamrick & Knudsen

[57] ABSTRACT

A concrete storage tank for storing large quantities of fluids, grains or other materials and including a circular tank sidewall formed of a plurality of vertically elongated wall elements having a generally Y-shaped transverse cross-section, a slab floor, a slab roof, a perimeter footing, a perimeter tie beam, and a central tower for access and for housing pumping equipment. In one method of construction the wall elements are formed in place while in an alternative method of construction, the elements are prefabricated at a remote location and then moved into place.

11 Claims, 14 Drawing Figures

CONCRETE STORAGE TANK AND METHOD OF MAKING SAME

BACKGROUND OF THE INVENTION

1. Field of the Invention

The present invention relates generally to large capacity storage apparatus, and more particularly to an improved concrete tank structure and methods of constructing same using a plurality of identical concrete wall elements which have high structural integrity for lateral loads.

2. Description of the Prior Art

The use of reinforced concrete tanks for storage of fluids, grains, etc., is well known. Such tanks are desireable because they do not require the constant maintenance and expense characteristic of steel tanks, and because they have a substantially longer life than wood tanks. The various types of concrete tanks known in the prior art are evidenced by the U.S. Pat. Nos. to Ingrahm, 1,001,273; Conzelman, 1,031,050; Laird, 2,414,310; Dobell, 2,932,964; Crown, 3,120,047; Closner, 3,217,451; Pritzker, 3,180,057; and 3,300,916; Alleaume, 3,511,003; Weaver, 3,619,431; Heron, 3,640,038; and Shelander, 3,824,751. Each of these patents discloses a concrete storage tank made by either pouring a formed wall, aligning a series of precast elements into a circular configuration and tying them together, or by wrapping a plurality of steel bands around an otherwise inadequately strengthened tank wall and molding or spraying a concrete coating thereupon. Such tanks are limited in their usefulness in that the poured walls usually cannot sustain high lateral loading, the precast element tanks require intricate connections between the elements and an unduely large amount of reinforcing steel to prevent the elements from separating at their joints and the band reinforced tanks require a large amount of steel banding which makes their construction expensive. Furthermore, all of these types of tanks require some degree of prestressing in order to insure against failure caused by loading forces which will be present when the tanks are filled; this of course further adds to the cost of construction.

A more important disadvantage of the prior art tank structures is that because of the manner of construction they are limited in size. This means that for such applications as dock oil storage applications and the like in which quantities of liquid exceeding a million barrels are stored, a plurality of prior art tanks must be provided thus requiring additional real estate, plumbing, maintenance, etc.

SUMMARY OF THE PRESENT INVENTION

It is therefore a principal object of the present invention to provide an extremely large concrete tank structure which can be built relatively quickly and economically.

Another object of the present invention is to provide a method of constructing a large concrete tank using a plurality of identical wall elements which can be either precast or poured in place and which is thus lower in cost, stronger and easier to construct than previous concrete tank structures.

Still another object of the present invention is to provide a concrete tank structure using wall elements that do not require prestressing in order to support the loading forces that will be present when the tank is filled.

Briefly, a preferred embodiment of the present invention includes a reinforced concrete floor; a reinforced concrete perimeter footing; a plurality of vertically elongated concrete wall elements having a generally Y-shaped transverse cross-section and which are arranged circumferentially around the floor and upon the perimeter footing and are interconnected to form a circular tank wall, a reinforced tie beam and integrally formed slab roof, and a centrally located access tower. Due to the nature of the tank structure the Y-shaped elements may be either poured in place at the construction site, or be prefabricated elsewhere and then placed and interconnected to one another at the construction site to form a continuous tank wall that can sustain extremely large lateral loads.

A principal advantage of the present invention is that it provides a concrete tank structure having a vertical side wall that is constructed from a plurality of identical individual elements which interact in such a manner that they are forced together by tank content loads rather than being forced apart.

Another advantage of the present invention is that the tank wall elements can be either fabricated at the building site or remote from the building site depending upon the particular construction circumstances.

Still another advantage is that due to the strength inherent in the wall configuration, prestressing of the tank wall is not necessary.

Still another advantage is that tanks made in accordance with the present invention are not size limited.

Still another advantage is that tanks can be made with roof constructions of metal, wood, plastic, or with no roof at all depending on the requirements of use, without materially changing the structural quality or integrity of the structure formed in accordance with present invention.

Still another advantage is that grain storage tanks constructed in accordance with the present inventions are inherently stable, have low soil loading pressure characteristics, and reduce the mechanical requirements for loading and unloading to a minimum.

Other objects and advantages of the present invention will no doubt become apparent to those skilled in the art after having read the following detailed description of a preferred embodiment which is illustrated in the several figures of the drawing.

IN THE DRAWING

Figure 4A:
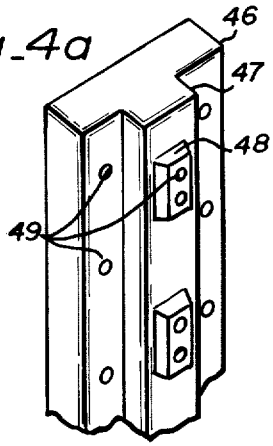
FIG. 4 is a partial plan view showing the method of fabricating the wall structure by sequentially pouring the wall elements in place.
Figure 4B:
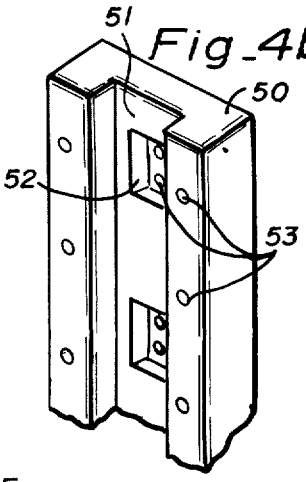
Figure 4C:
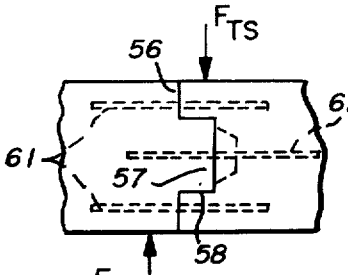
Figure 4D:
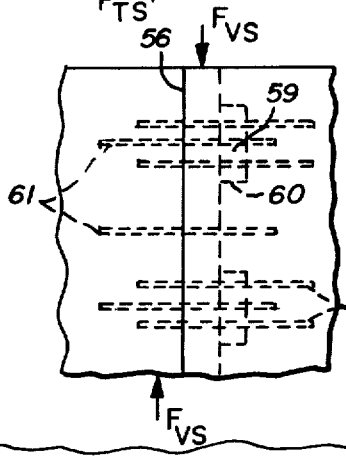
Figure 4:
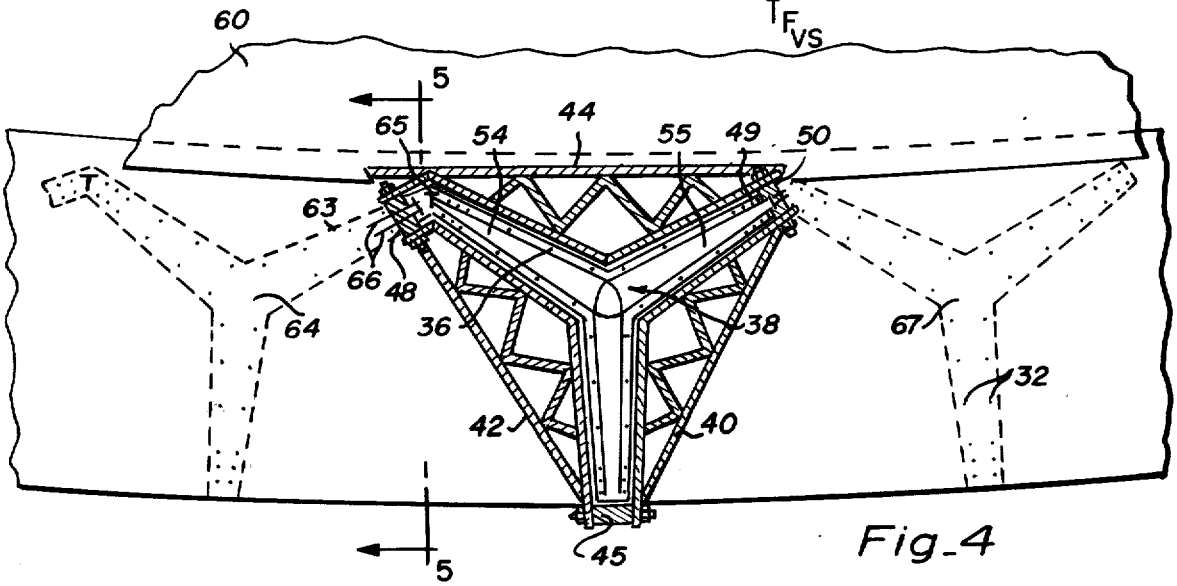
Figure 5:
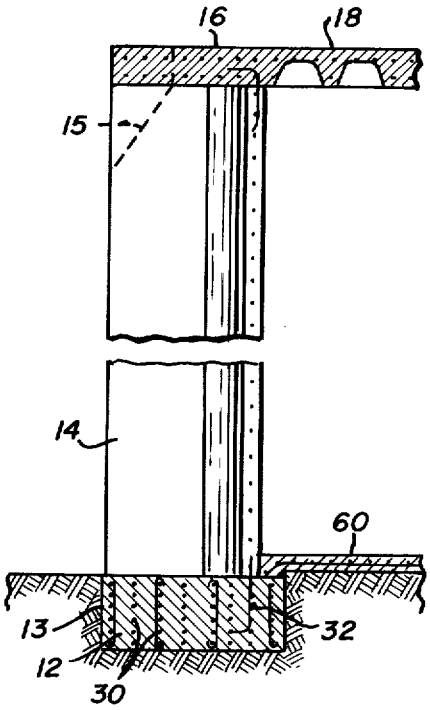
Figure 6:
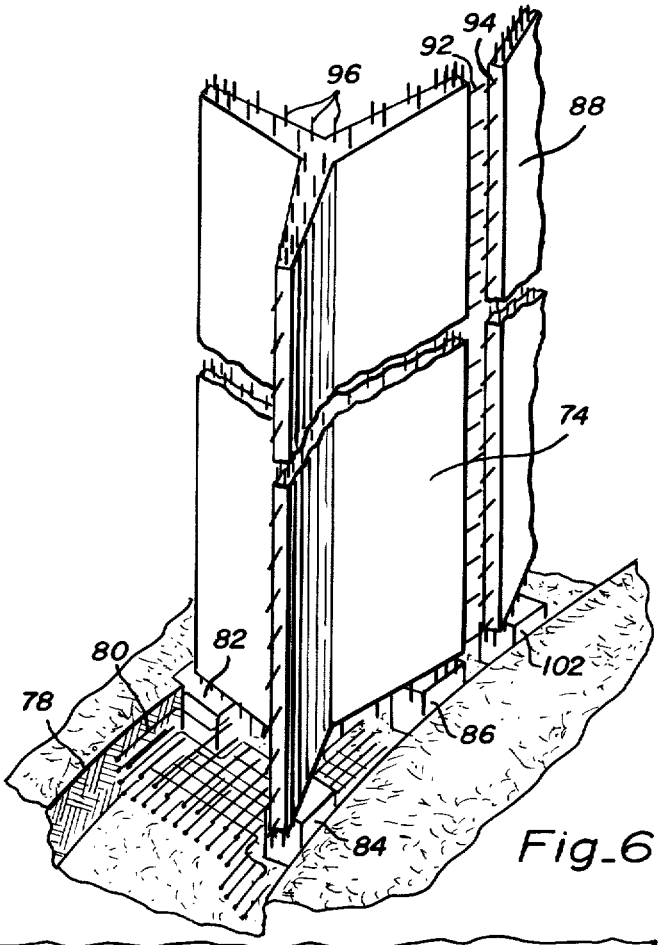
Figure 7:
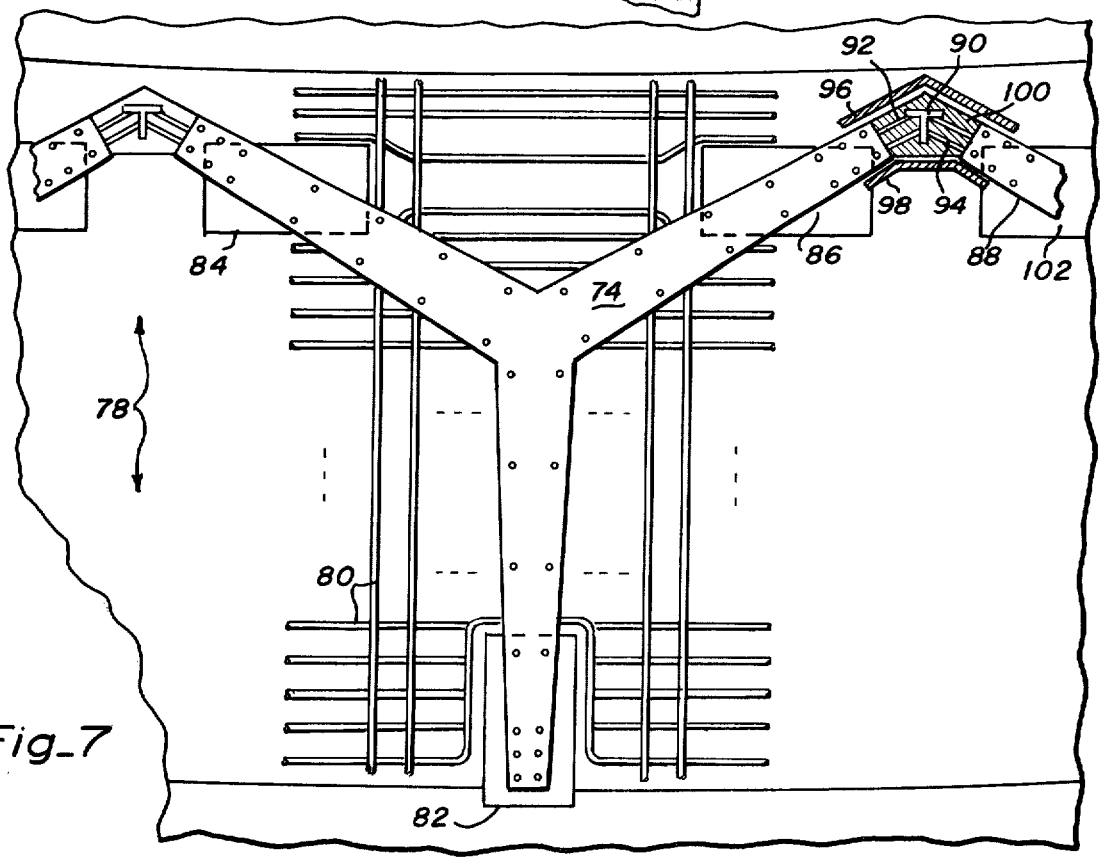
Figure 8:
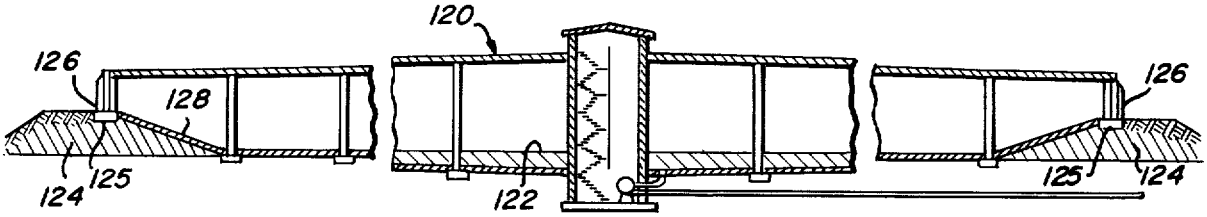
Figure 9:
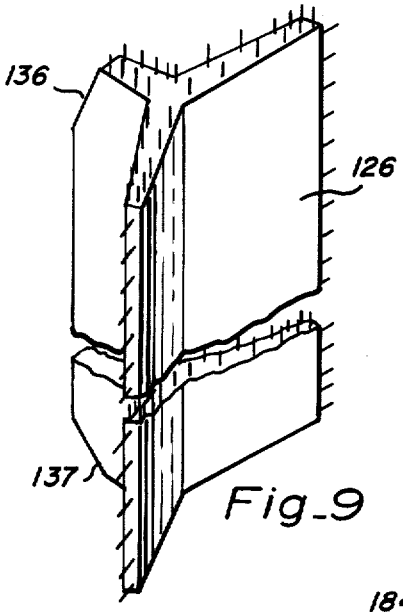
Figure 10:
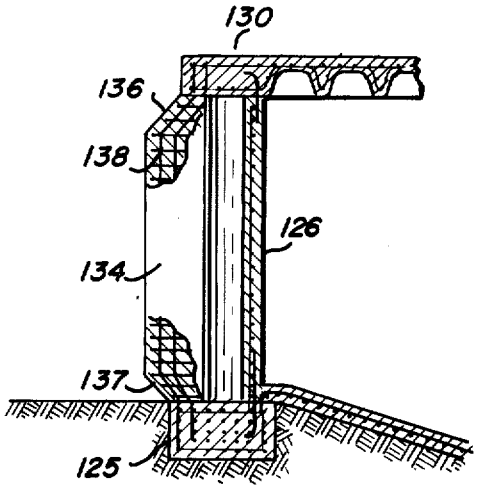
Figure 11:
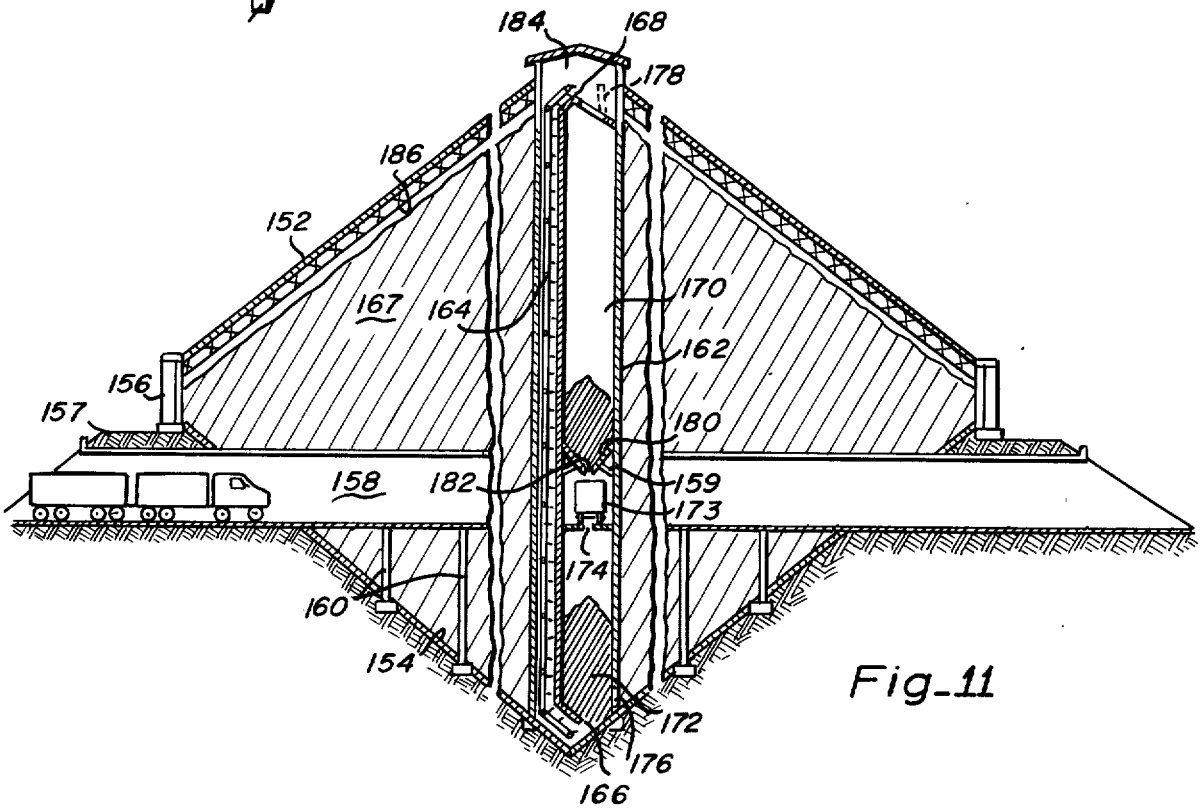

FIGS. *4a–4d* are views showing details of the structure illustrated more generally in FIG. 4;

FIG. 5 is a partial cross-section showing footing, floor, wall, tie beam and roof construction;

FIG. 6 is a perspective view of a prefabricated wall element shown set in place in accordance with an alternative method of construction;

FIG. 7 is a plan view showing the manner in which the prefabricated wall elements illustrated in FIG. 6 are joined to form a tank wall;

FIG. 8 is a cross-sectional view depicting an alternative embodiment of a concrete storage tank in accordance with the present invention;

FIG. 9 is a broken perspective view showing a prefabricated wall element modified for use in the embodiment illustrated in FIG. 8;

FIG. 10 is a partial cross-section footing, floor, wall, tie beam and roof construction details of the alternative embodiment shown in FIG. 8; and FIG. 11 is a cross-section showing another alternative embodiment of the present invention particularly suited for grain storage applications.

DETAILED DESCRIPTION OF THE PREFERRED EMBODIMENT

Figure 1:
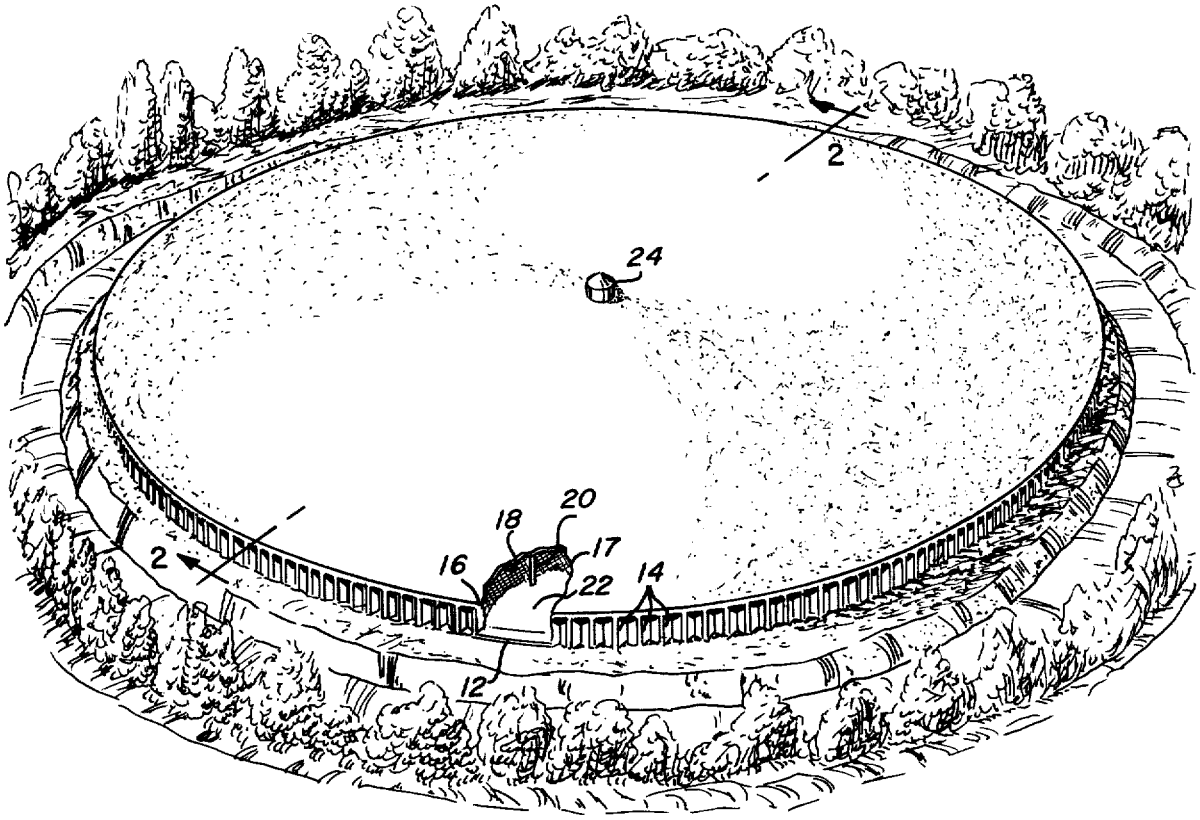
FIG. 1 is a perspective viwe of a concrete storage tank constructed in accordance with the present invention.
Figure 2:
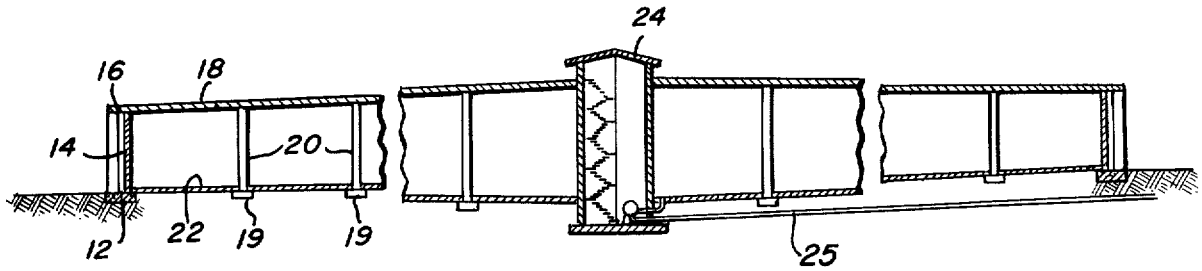
FIG. 2 is a broken cross-section taken along the diameter line 2—2 of FIG. 1.

Referring to FIGS. 1 and 2 of the drawing, there is shown a storage tank 10 in accordance with a preferred embodiment of the present invention. Tank 10 generally includes a concrete perimeter footing 12, a plurality of vertical wall elements 14 disposed upon footing 12 and arranged in abutting relationship to each other to form a continuous tank wall, a concrete tie beam or header 16, shown at the broken away section 17 in FIG. 1, a roof structure 18 which may be formed integral with tie beam 16 and which is supported by both wall 14 and interior post columns 20, a concrete floor 22, and a centrally located tower and access building 24. Disposed beneath the tank floor 22 is a pipe, conduit or other means forming a material conveying passageway 25 which extends from outside the tank perimeter to the tower 24 so as to provide a means for filling and emptying the tank 10. In the preferred embodiment, all of the previously mentioned elements are fabricated of steel-reinforced concrete. However, since the roof is not depended upon for structural integrity of the tank walls, it is to be understood that the roof could alternatively be constructed of metal, wood, plastic or other materials. Moreover, in certain applications the roof may be dispensed with entirely.

Figure 3:
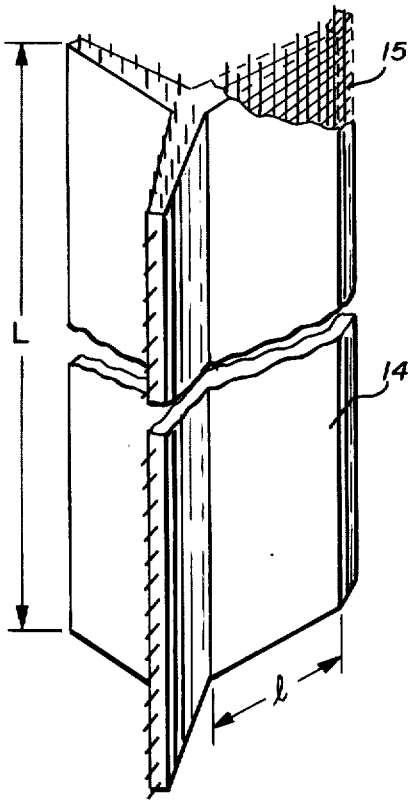
FIG. 3 is a broken perspective showing a single wall element of the type used in the tank illustrated in FIGS. 1 and 2.

The wall elements 14, one of which is illustrated generally in FIG. 3, are vertically elongated, steel-reinforced members having a generally Y-shaped transverse cross section. The three legs of the Y-shaped wall element are disposed 120° relative to each other and are internally strengthened by a network of steel bars 15 disposed both vertically and horizontally as illustrated at the broken-away section. An early embodiment of a similarly configured Y-shaped element is disclosed in my earlier U.S. Pat. No. 2,746,283.

In order to place the element 14 in proper perspective, when used in a 1,200,000 barrel embodiment such as is illustrated in FIGS. 1 and 2 the vertical length L of the walled element 14 is approximately 30 feet and the horizontal length $l$ of each of the three legs forming the Y-shaped cross section is approximately 8 feet. In addition, the thickness of the legs at their outer extremity is 10 inches while the thickness at the root of each leg is approximately 20 inches. In the preferred embodiment the vertical steel includes No. 4 and No. 9 bars, and the horizontal steel includes No. 4 bars. Each wall element weighs approximately 62 tons.

Turning now additionally to FIGS. 4 and 5 of the drawing, the preferred method of construction of the tank 10 illustrated in FIGS. 1 and 2 will be described. The first step in the construction of the tank, after the site has been leveled and the plumbing and electrical conduits have been installed, is to excavate a circular trench 13 into which the footing 12 will be formed. In the stated example the inside diameter of the ditch will be approximately 540 feet and the trench, i.e., the footing 12 will be approximately 14 feet wide and 4 feet deep. When the trench is prepared, the structural steel shown schematically at 30 is placed, including upstanding stud bars 32 which extend beyond the top of the finished footing. In the preferred embodiment, heavy reinforcing steel, typically No. 11 bars, used for bars 30. The stud bars 32 are disposed along the footprints of the wall elements 14 to be later formed thereover. Concrete is then poured and the upper surface of the footing 12 is finished. It will be appreciated that the entire footing 12 need not be consturcted at one time and may actually be constructed in arcuate sections.

Once the footing is poured and cured for an appropriate period of time the reinforcing steel 36 for the first wall element 38 is erected and tied to the stud bars 32, and the forms 40, 42 and 44 (FIG. 4) are positioned thereabout and secured in place. The forms 40–44 are freestanding structural members which are bolted together to provide a top loaded forming receptable. The interior walls of the forms may be either plain or of a vacuum-form configuration. Furthermore, the vertical length of the assembled form structure may correspond to the finished length of the Y-shaped element 14 or be made in sections which are to be stacked so that the members can be poured in several stages.

The open ends of the form legs are respectively closed by a flat faced member 45; a member 46 such as is partially shown in FIG. 4*a* having a vertical ridge 47, a plurality of keyway forming plugs 48, and openings 49 for reinforcing bars; and a member 50 such as is partially shown in FIG. 4*b* having a vertical groove 51, a plurality of key forming recesses 52, and openings 53 for reinforcing bars. The members 46 and 50 form the end surfaces of the respective legs 54 and 55 in such a manner that the adjoining legs of adjacent wall elements are keyed to resist separation by either vertical or horizontal transverse forces. More specifically, as shown in the FIG. 4*c* plan view of a joint 56, the vertical ridge 56 and groove 58 resist transverse shear forces $F_{TS}$, while as shown in the FIG. 4d partial elevation view of the joint 56, the keys 59 and keyways 60 resist vertical shear forces $F_{VS}$. The steel reinforcing bars 61 and 62 of course in maintaining the structural integrity of the interlocking members as well as resisting any forces tending to separate the joint.

Note that the edges of forms 42 and 44 project beyond the normal length of leg 5′ and are deflected to form a junction with the leg 63 of an adjacent wall member represented by the dashed lines 64 which might have been previously poured. Note also, that in placing the reinforcing steel for leg 54, a steel T-beam 65 is positioned at the apex of leg 54 and leg 63, and the horizontal reinforcing bars leg 54 and those extending from leg 63 (where member 64 has been previously poured) are welded thereto. In the illustration, stud bars 66 are shown projecting through end block 48. Similarly, the horizontal bars in leg 55 extend through the end block 50 so that they may be welded a T-beam to be positioned at the next apex during the fabrication of the wall member to be positioned in the footprint 67. Concrete is then poured into the form to complete construction of element 38.

During the time that element 38 is curing, the reinforcing bars for element 48 may be erected, and as soon as element 38 is cured sufficient to be self-supporting, the forms 40–44 are removed and positioned to form the next element 67. The construction of the wall elements thus proceeds in sequence until the entire wall is complete. If wall element is the first in a series to be poured, it will be appreciated that the next poured may be either element 64 or 67, or both may be fabricated simultaneously.

It will of course also be apparent that in accordance with this method of construction, the tank wall could be fabricated in separate arcuate sections by several crews working simultaneously to form the several sections which would later be joined as the last element of each segment is formed contiguous with an adjacent element of another section. While the various wall sections are being fabricated, work on the footing pads 19, columns 20 and tower 24 can also be proceeding. And once the pads 19, columns 20 and wall elements 14 in a given tank section have been completed, the steel reinforced slab 60 can be poured in that section.

As soon as the floor slab has cured sufficient to support weight, forms can be erected for fabricating the tie beam 16, and the roof structure 18 when included. Tie beam 16 and footing 12 form tension rings which provide structural integrity to the top and bottom of the tank at its outer perimeter. And since the lateral loading on the upper portion of each wall element 14 is usually less than that on the lower portion, it may not be necessary to extend the width of tie beam 16 to the full width of the wall elements. In such cases the upper portion of the outside legs of the wall elements may be tapered as indicated by the dashed line 15 in FIG. 5. Although the roof of tank 10 may be constructed of any suitable materials using any suitable configuration, in the preferred embodiment the roof is a ribbed or honeycomb structure of reinforced concrete, as generally indicated in FIG. 5, and may be formed either separate from or integral with tie beam 16.

Referring now to FIGS. 6 and 7 of the drawing, an alternative method of forming the tank wall will be discussed. In accordance with this method, the Y-shaped wall elements 74 are prefabricated at a location remote from their final position and with reinforcing bars 76 extending from the upper and lower end surfaces of each leg and from the side edge surfaces of the two interior legs. The footing trench 78 is prepared and steel reinforcing bars 80 are placed as before except that the reinforcing bars are positioned around wall member support blocks 82, 84 and 86 which are also positioned within trench 78.

The wall members 74 are then lifted and positioned upon the blocks 82–86, leveled and laterally braced. Once at least two adjacent wall members (74 and 88 in FIG. 6) are located, a steel T-beam 90 is positioned in the junction space between the two members and the reinforcing bars 92 and 94 of the respective members are welded thereto. Forms 96 and 98 are then positioned on the front and back sides of the space separating members 74 and 78 and concrete may be poured therebetween to form the concrete joint illustrated at 100. The concrete footing may be poured either before the wall joints are formed or afterwards. However, once the concrete is set, the forms may be removed and installed between any other two adjacent elements for use in forming a joint at that location. Although this method may have the advantage of permitting the forms to be fabricated at a single location, it has the disadvantage that means must be provided for moving the extremely heavy prefabricated wall elements. It is therefore a question of site location, available equipment, or other practical or economic considerations that will determine which of the two above described methods of fabricating the wall are to be used.

Turning now to FIGS. 8 through 10, an alternative embodiment of a tank structure is shown at 120 wherein earth excavated in preparing the tank floor, i.e. that earth represented by the shaded area 122 is used to form a circular berm 124 in order to (1) dispose of the unneeded soil and (2) to lessen the cost of construction by reducing the vertical length of the wall elements 126. It also has the effect of causing the sloped floor portion 128 to bear the largest part of the lateral forces exerted upon the tank structure by its contents. In this case and as indicated in FIG. 8, the footing 126 is constructed atop the berm 124. As a result, the vertical length of the wall elements 126 is substantially less than that of the previously described embodiments. The weight thereof is thus substantially less, and because the largest portion of the lateral forces exerted by the fluid contents of the tank are born by the sloping floor 128, the size of footing 126 in both depth and width can be substantially less thereby saving concrete and steel.

In addition, the horizontal dimension of the lateral leg 134 of each wall element 126 can be reduced as indicated in order to realize further savings in concrete and steel. Where the required dimension of leg 134 exceeds the required widths of tie beam 130 and footing 125 the leg may be tapered at top and/or bottom as indicated at 136 and 137 in FIGS. 9 and 10. The layout of the vertical reinforcing steel 138 in leg 134 would of course be likewise modified as illustrated in FIG. 10.

Turning now to FIG. 11, still another alternative embodiment of the present invention is illustrated which is specially adapted for use as a grain elevator tank. In this embodiment, the side wall elements 150 may be configured as in any of the previously described embodiments but the slopes of the roof 152 and floor 154 are increased to approximately the angle of repose of the material to be stored in the tank. For example where the material to be stored is wheat the roof and floor slopes might be 40°. In so sloping the roof 152 substantially the entire volume of the tank can be filled, thereby permitting maximum use of the tank volume. And by sloping the floor 154 as indicated, all of the stored material can be made to fall to the bottom of the tank under its own weight, thus, greatly facilitating its removal.

In this embodiment which is illustrated with the center section broken away and rotated 90° relative to the remainder of the tank, the tank wall 156 is constructed on a berm 157 made using the soil excavated from the center of the tank, and a railway tunnel or other passageway 158 is provided at grade level passing beneath the tank wall and through the middle of the tank. That portion of the tunnel which passes through the tank is supported on columns 160. As indicated in the center section, which is a cross section of the tunnel, the roof 159 of the tunnel is sloped to either side at the same angle as the roof 152 and floor 154.

An elevator tower 162 is provided at the center of the tank and includes an elevating conveyor 164 which lifts material from the tank bottom 166 and discharges it onto a sloped surface 168 near the top of tower 162 where it falls into the main tank chamber 167. The tower 162 forms an upper chamber 170 above the tunnel 158, and a lower chamber 172 beneath the tunnel. Openings 174 are provided beneath the rails in tower 162 so that a bottom dumping freight car 173 can discharge its load into chamber 172 where it will be lifted by conveyor 164 to the top of the tank and be deposited into the main tank chamber.

By providing openings 176 around the base of tower 162, a doorway 178 in surface 168 and sloped sides 180 and an opening 182 in tunnel roof 159, the elevator 164 can also be used to load stored material from the bottom of the tank into car 173. The tower top 184 includes suitable openings or other ventilating means for discharging heat and dust.

As in the previously described tank embodiments the wall 156 is the principal structural feature in that it ties the remainder of the structure together and thus resists the major loading forces. In fact, the wall's strength in resisting lateral loads coupled with the highly sloped roof permits the use of relatively lightweight trusses 186 suspended from the wall and tower to provide an unobstructed tank interior.

Although the present invention has been described with relationship to several alternative embodiments it is contemplated that numerous alterations and modifications thereof will become apparent to those skilled in the art. For example, where real estate considerations or the like control, the tank might be made rectangular, polygonal oval or elliptical rather than round. Furthermore, the roof structure might be made of some other material or configuration. For example, it might be made flat or be only slightly sloped so that it can be used as a parking lot, playground, ball field, etc.

Accordingly, it is intended that the appended claims be interpreted to cover all such alterations and modifications at fall within the true spirit and scope of the invention.

What is claimed is:

1. A tank structure comprising:

a perimeter footing forming the lower outer side limits of the tank structure;

a plurality of vertically elongated wall elements each having a generally Y-shaped transverse cross section, said wall elements being disposed consecutively along said footing and rigidly affixed thereto, each such wall element having a first leg extending in an outwardly direction relative to said footing, and second and third legs extending in generally inwardly directions relative to said footing with each angularly intersecting and being joined with a leg of an adjacent wall member to form a closed tank wall;

a tie beam tieing the tops of said wall members rigidly together and forming the upper outer limits of said tank;

a tank floor covering the area circumscribed by said footing;

an access tower disposed in a central portion of said tank structure; and means forming a passageway extending beneath said footing and through said tower to provide means for filling and emptying said tank structure with material to be stored.

2. A tank structure as recited in claim 1 wherein said footing, wall elements and tie beam are steel reinforced concrete members.

3. A tank structure as recited in claim 1 wherein the legs of each said all element are disposed at 120° angles relative to each other.

4. A tank structure as recited in claim 3 wherein each said leg extends radially outwardly from the center of said wall element and the horizontal lengths of said legs are equal.

5. A tank structure as recited in claim 1 wherein said wall elements are made of concrete which is steel reinforced with horizontally and vertically disposed steel bars, the horizontal bars of the second leg of each said wall element being affixed to the horizontal bars of the third leg of an adjacent wall element.

6. A tank structure as recited in claim 1 wherein said perimeter footing is disposed on a berm and the central portion of said floor is disposed within the area circumscribed by said berm and at an elevation substantially lower than said footing, said central portion being joined to said footing by an outer portion of said floor which slopes downwardly from said footing at a relatively steep angle.

7. A tank structure as recited in claim 6 wherein the vertical length of each said wall element is less than one-half the maximum depth of said tank structure.

8. A tank structure as recited in claim 7 wherein the width of said footing is less than the footprint width of one of said wall elements and wherein the first leg of each said wall element extends outside of said footing.

9. A tank structure as recited in claim 1 wherein said wall elements are made of concrete which is steel reinforced with horizontally and vertically disposed steel bars, and wherein the horizontal bars of each second leg of each said wall element and the horizontal bars of each third leg of an adjacent wall element are affixed to a structural steel member disposed between the facing outer extremities of the legs, said steel member being enveloped in a concrete section joining said outer extremities.

10. A tank structure as recited in claim 1 which is round and includes a roof which is conical, the slope of said roof being selected to match the angle of repose of the material to be deposited in said tank structure, said roof having a central opening for receiving said material.

11. A tank structure as recited in claim 10 wherein said floor is conical in configuration and slopes toward the tank center at an angle selected to match the angle of repose of the material to be stored in said tank structure.

* * * * *